US006434805B2

(12) United States Patent
Haimoff

(10) Patent No.: US 6,434,805 B2
(45) Date of Patent: Aug. 20, 2002

(54) METHOD OF MAKING A HEART-SHAPED DIAMOND

(75) Inventor: Ami Haimoff, New York, NY (US)

(73) Assignee: L.I.D. Ltd., New York, NY (US)

( * ) Notice: Subject to any disclaimer, the term of this patent is extended or adjusted under 35 U.S.C. 154(b) by 0 days.

(21) Appl. No.: 09/850,869

(22) Filed: May 8, 2001

Related U.S. Application Data

(62) Division of application No. 09/268,446, filed on Mar. 12, 1999, now abandoned.

(51) Int. Cl.[7] ..... B23P 5/00
(52) U.S. Cl. ..... 29/10; 63/26; 63/32
(58) Field of Search ..... 29/896.4, 896.41, 29/10; 63/26–28, 32

(56) References Cited

U.S. PATENT DOCUMENTS

| | | | | | |
|---|---|---|---|---|---|
| D62,992 | S | * | 9/1923 | Heller | D11/90 |
| D196,868 | S | * | 11/1963 | Nagy | D11/90 |
| D209,771 | S | * | 1/1968 | Saltzman | D8/394 |
| 3,394,692 | A | * | 7/1968 | Sirikian | 63/28 |
| 4,503,687 | A | * | 3/1985 | Tessler et al. | 63/29 |
| 4,878,364 | A | * | 11/1989 | Freilich | 63/28 |
| 5,533,364 | A | * | 7/1996 | Freilich | 63/32 |
| D373,551 | S | * | 9/1996 | Udko | D11/90 |
| D384,593 | S | * | 10/1997 | Katz | D11/90 |
| D388,015 | S | * | 12/1997 | Itkowitz | D11/90 |
| D388,017 | S | * | 12/1997 | Kejejian | D11/91 |
| D392,590 | S | * | 3/1998 | Bachar | D11/90 |
| D400,121 | S | * | 10/1998 | Ambar | D11/91 |
| D402,913 | S | * | 12/1998 | Katz | D11/90 |

FOREIGN PATENT DOCUMENTS

| | | | | |
|---|---|---|---|---|
| FR | 1129301 | * | 1/1957 | 63/28 |
| GB | 1015310 | * | 12/1965 | 63/32 |

* cited by examiner

*Primary Examiner*—P. W. Echols
(74) *Attorney, Agent, or Firm*—Ezra Sutton

(57) ABSTRACT

A heart shape diamond and setting therefore including a first diamond section formed by cutting a first pear-shaped diamond along a first cutting plane to define a first mating surface and a first table; and a second diamond section formed by cutting a second pear-shaped diamond along a second cutting plane to define a second mating surface and a second table. A heart-shaped setting is provided having a first seating area and a second seating area separated by a cross bar, wherein the first diamond section is seated in the first seating area and the second diamond section is seated in the second seating area, with the first mating surface engaging the second mating surface to form the heart shape diamond, and with the first table and the second table forming the appearance of a single table of the heart shape diamond. Further, the first pear-shaped diamond has a first culet and the second pear-shaped diamond has a second culet, and wherein the heart shape diamond has both first and second culets therein.

12 Claims, 7 Drawing Sheets

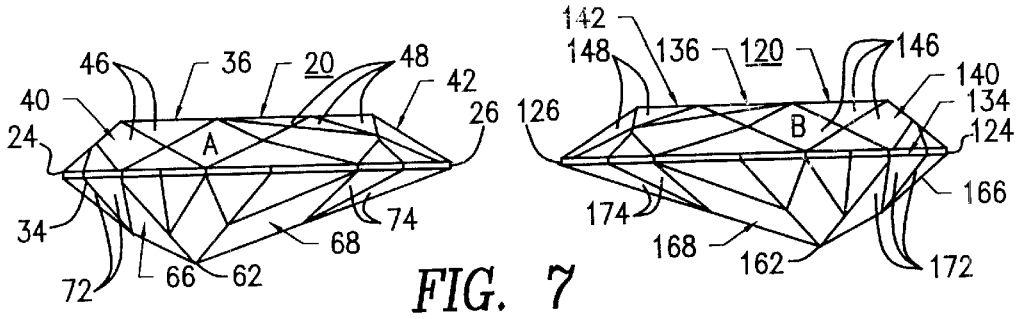
FIG. 7
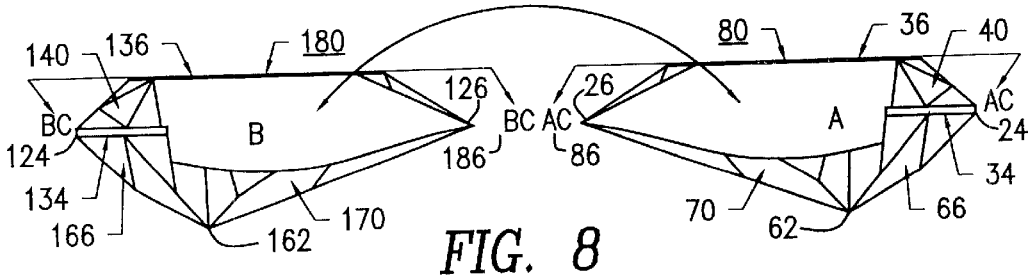
FIG. 8
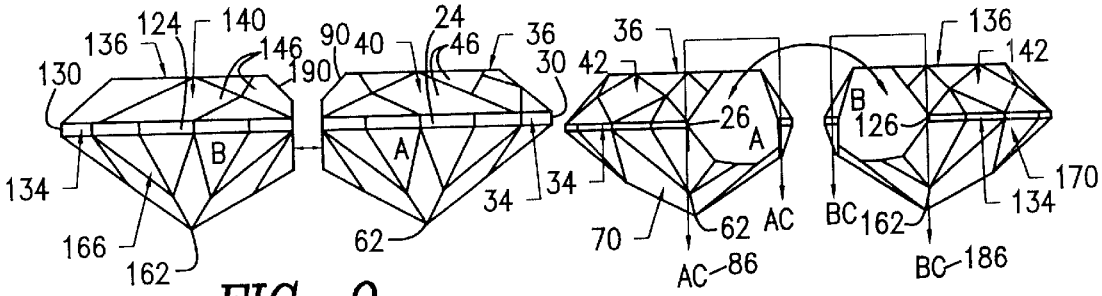
FIG. 9
FIG. 10
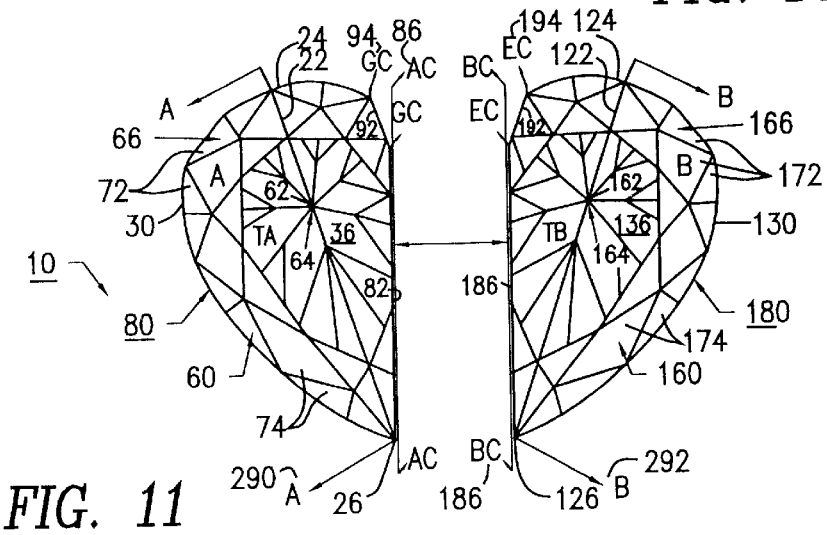
FIG. 11

METHOD OF MAKING A HEART-SHAPED DIAMOND

This application is a division of application Ser. No. 09/268,446, filed Mar. 12, 1999, now abandoned.

FIELD OF THE INVENTION

The present invention relates to a heart-shaped diamond made by cutting two pear-shaped diamonds and placing them together to form a heart-shaped diamond. More particularly, the two cut sections of the pear-shaped diamonds are placed within a setting for a diamond ring or brooch such that the two diamond sections are held in place and form a single heart-shaped diamond ring, brooch, earrings, or any other diamond jewelry.

BACKGROUND OF THE INVENTION

Heart-shaped jewelry articles in the form of rings, pins, brooches, pendants, clasps, necklaces, bracelets, anklets, earrings, and the like are popular throughout the world for personal adornment. These heart-shaped jewelry articles are made from gems, gemstones, gold, silver, platinum and the like, wherein these articles are manufactured typically by molding (heart-shaped gold jewelry), by cutting (heart-shaped zirconium), or by abrading (heart-shaped jade). Semi-precious stones such as aquamarine, amethyst, topaz, garnet, quartz, opal, turquoise, moonstone and jade are typically abraded into a heart-shaped semi-precious stone configuration with little processing problems. Precious stones such as diamonds, rubies, emeralds, and sapphires are harder to cut and transform into a heart-shaped configuration. The heart-shaped configuration is not a typical precious stone cut such as a round, a pear-shape, an oval shape, an octahedron-shape and a marquise. Forming the heart-shaped configuration by a diamond cutter is a slow and tedious process with limited success by the cutter to form the heart-shaped design from a single gem.

There remains a need for heart-shaped gemstones, such as a diamond, formed by cutting two diamonds into two skewed mating sections, such that the two cut mating sections are placed side-by-side within a heart-shaped metal setting and are held in place to form the appearance of a single heart-shaped gem for use in a particular type of ornamental jewelry, such as a ring, a pin, a clasp, a pendant, a brooch, a necklace, or earrings.

DESCRIPTION OF THE PRIOR ART

Heart-shaped jewelry made from gems and gemstones having various designs, structures, configurations and materials of construction have been disclosed in the prior art. For example, U.S. Pat. No 4,878,364 to FREILICH discloses a double faced jewelry setting in order to create jewelry articles, such as a heart-shaped pendant and a cross-shaped pendant made from a plurality of round diamonds. This prior art patent does not teach the method of forming the appearance of a single heart-shaped gem (diamond) by cutting two pear-shaped diamond sections and mating them in a single setting.

U.S. Pat. No. 4,503,687 to TESSLER et al discloses a process of mounting gemstone clusters onto a metal setting, such that the plurality of gemstones are arranged in a desired cluster or geometrical pattern, such as a heart-shaped pendant, a clown-shaped pendant and the like. This prior art patent does not teach the method of forming the appearance of a single heart-shaped gem (diamond) by cutting two pear-shaped diamond sections and mating them in a single setting.

None of the prior art patents teach or disclose a method of forming the appearance of a single heart-shaped diamond by cutting two pear-shaped diamonds, and placing the cut sections side-by-side in a metal setting to form the appearance of a single heart-shaped diamond for making a specific type of ornamental jewelry to be worn by the user, as shown in the present invention.

Accordingly, it is an object of the present invention to provide a method of forming the appearance of a single heart-shaped gem by cutting two pear-shaped gems, and placing the two cut gem sections side-by-side in a heart-shaped metal setting for holding them in place to form the appearance of a single heart-shaped gem for making a particular type of ornamental jewelry to be worn by the user.

Another object of the present invention is to provide a method of forming a heart-shaped gem by cutting two pear-shaped gems such as diamonds, rubies, emeralds, sapphires, and the like.

Another object of the present invention is to provide a method of forming a heart-shaped gem for use in personal adornment in the form of ornamental jewelry such as rings, pins, brooches, pendants, clasps, necklaces, bracelets, anklets and earrings.

A further object of the present invention is to provide a method of forming a heart-shaped gem that is easy to mount within a metal setting and wherein the formed heart-shaped gem will not separate once mounted.

SUMMARY OF THE INVENTION

The present invention provides for a heart shape diamond and setting therefor including a first diamond section formed by cutting a first pear-shaped diamond along a first cutting plane to define a first mating surface and a first table; and a second diamond section formed by cutting a second pear-shaped diamond along a second cutting plane to define a second mating surface and a second table. A heart-shaped setting is provided having a first seating area and a second seating area separated by a cross bar; wherein the first diamond section is seated in the first seating area and the second diamond section is seated in the second seating area with the first mating surface engaging the second mating surface to form a heart shape diamond with the first table and the second table forming the appearance of a single table of the heart shape diamond.

Further, the first pear-shaped diamond has a first main culet and the second pear-shaped diamond has a second main culet, and wherein the heart shape diamond has both of the first and second culets therein.

In addition, the first pear-shaped diamond has a first central axis and a first cutting plane which forms an angle alpha $\alpha$ with the first central axis, wherein the angle alpha $\alpha$ is in the range of 10° to 30°; and the second pear-shaped diamond has a second central axis and a second cutting plane which forms an angle beta $\beta$ with the second central axis, wherein the angle beta $\beta$ is in the range of 10° to 30°.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein:

FIG. 7 is a side elevational view of the two pear-shaped diamonds PSA and PSB in preparation for being cut showing each of the longitudinal cutting planes AC—AC and BC—BC for cutting and forming each of the skewed (angled) diamond sections A and B, respectively, used to form the heart-shaped diamond;

FIG. 8 is a side elevational view of the two skewed (angled) diamond sections A and B showing the joining of the cutting planes AC—AC and BC—BC of the sections A and B, respectively, to form the heart-shaped diamond;

FIG. 9 is a top end elevational view of the two skewed (angled) diamond sections A and B showing the joining of the cutting planes AC—AC and BC—BC of the sections A and B, respectively, to form the heart-shaped diamond;

FIG. 10 is a bottom point-end elevational view of the two skewed (angled) diamond sections A and B showing the joining of the cutting planes AC—AC and BC—BC of the sections A and B, respectively, to form the heart-shaped diamond;

FIG. 11 is a top view of the two skewed (angled) diamond sections A and B depicting the top facets and the bottom facets within each of the tables TA and TB of sections A and B, respectively, and showing the joining of the two cutting planes AC—AC and BC—BC of sections A and B, respectively, to form the heart-shaped diamond;

DETAILED DESCRIPTION OF THE PREFERRED EMBODIMENT

Figure 1:
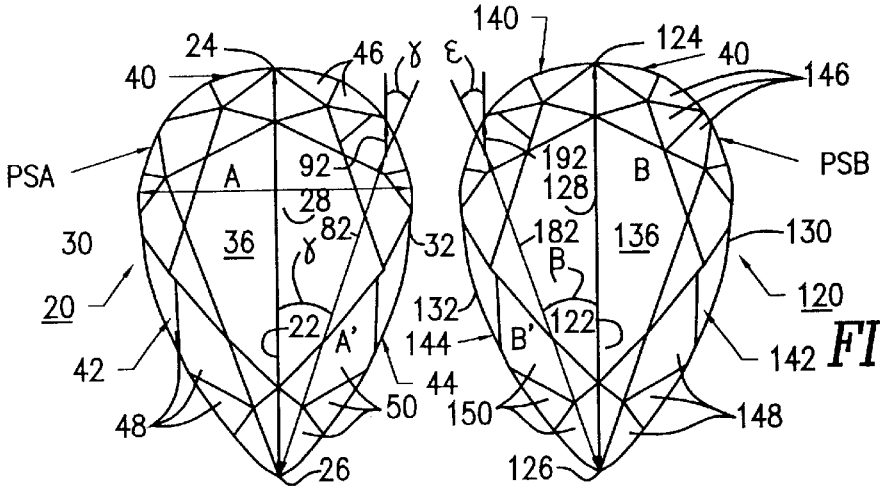
FIG. 1 is a top view of two pear-shaped diamonds in preparation for being cut showing the angle $\alpha$, the angle $\gamma$, the angle $\beta$, and the angle $\epsilon$ measured from each of the longitudinal axis lines, respectively, of the pear-shaped diamonds PSA and PSB, for defining each of the longitudinal cutting planes AC—AC, GC—GC, BC—BC and EC—EC for cutting and forming each of the skewed (angled) diamond sections A and B, respectively, used to form the heart-shaped diamond.

The heart-shaped diamond 10 and its component parts of the preferred embodiment of the present invention are represented in detail by FIGS. 1 through 19 of the patent drawings. Heart-shaped diamond 10 includes two skewed (angled) diamond sections (A and B) 80 and 180 that are joined together and held in place within a heart-shaped metal gem setting 300 for use as an ornamental piece of jewelry. The skewed diamond sections 80 and 180 are cut from a pair of pear-shaped diamonds (PSA and PSB) 20 and 120, being cut along cutting planes (AC—AC) 86 and (BC—BC) 186 of each pear-shaped diamond 20 and 120, respectively, as shown in FIGS. 2, 3, 5, 6 and 8 to 10 of the drawings.

Figure 4:
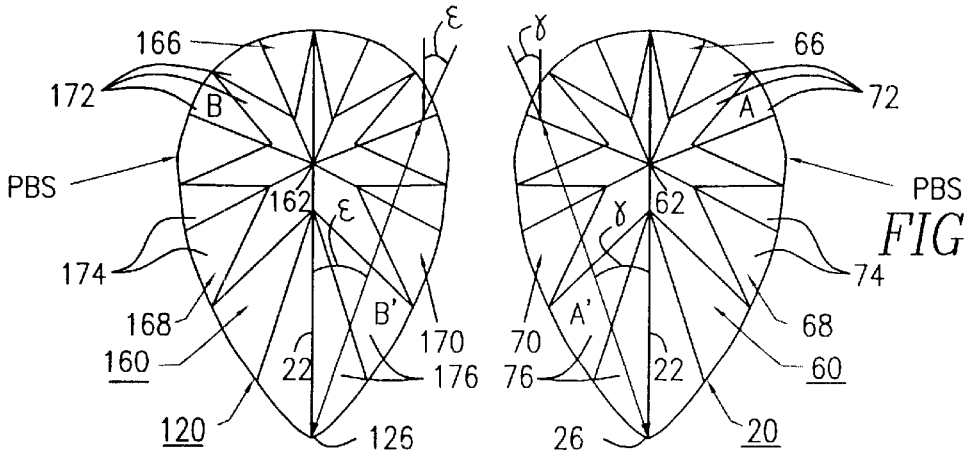
FIG. 4 is a bottom view of two pear-shaped diamonds in preparation for being cut showing the angle $\alpha$, the angle $\beta$, the angle $\gamma$, and the angle $\epsilon$ measured from each of the longitudinal axis lines, respectively, of the pear-shaped diamonds PSA and PSB, for defining each of the longitudinal cutting planes AC—AC, GC—GC, BC—BC and EC—EC for cutting and forming each of the skewed (angled) diamond sections A and B, respectively, used to form the heart-shaped diamond.

The first pear-shaped diamond (PSA) 20, as shown in FIGS. 1 and 4 of the drawings, includes a longitudinal central axis line 22 extending from end edge 24 to opposed end point 26, and a short cross-axis line 28 extending from side edge 30 to opposed side edge 32. The axis lines 22 and 28 are determined by the parameters of the girdle 34 of diamond 20. The longitudinal axis line 22 is longer in dimension than the cross-axis line 28. The table 36 of diamond 20 refers to that flat, horizontal planar surface confined within the crown facets. The crown facets are defined by a crown top-end facet 40 and a pair of opposed crown side facets 42 and 44, respectively. Crown top-end facet 40 includes a plurality of angled top crown facets 46. Crown side facets 42 and 44 each include a plurality of angled side crown facets 48 and 50, respectively, as shown in FIG. 1 of the drawings.

Figure 5:
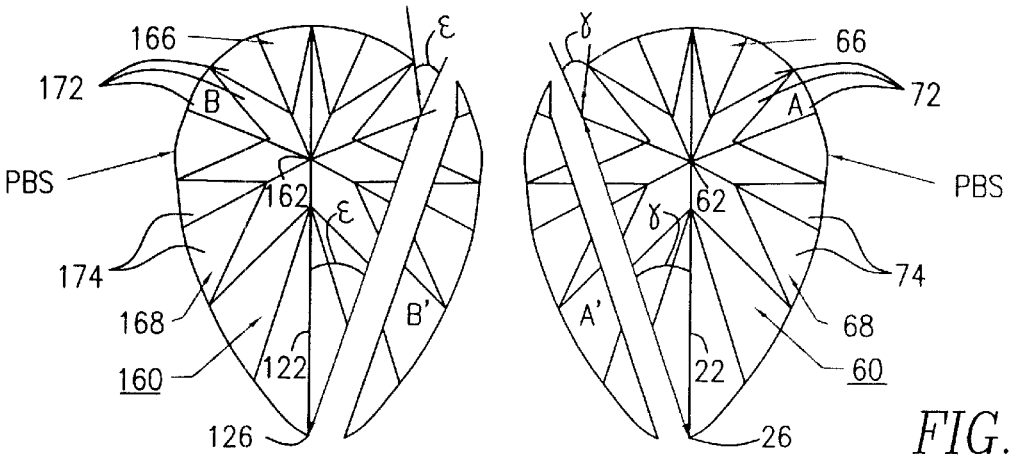
FIG. 5 is a bottom view of the two pear-shaped diamonds after being cut along each of the cutting planes AC—AC, GC—GC, BC—BC and EC—EC, respectively, to form skewed sections A, A', B and B' from the pear-shaped diamonds PSA and PSB, respectively.
Figure 6:
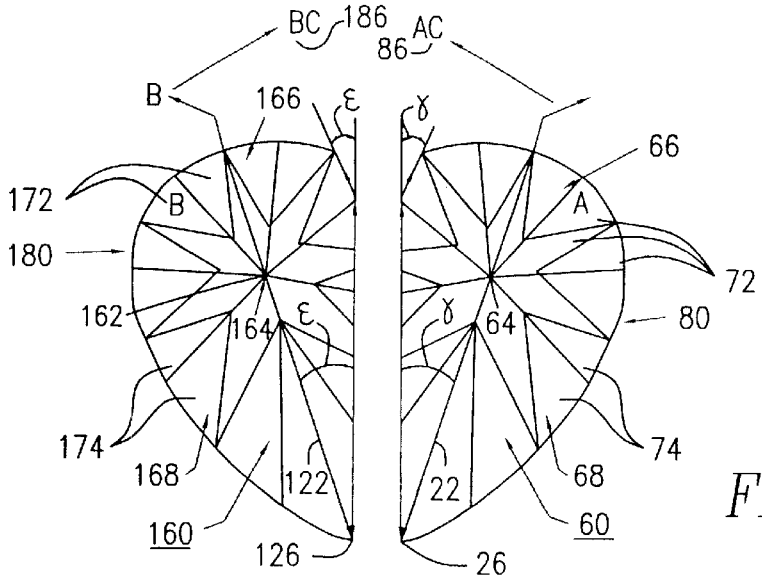
FIG. 6 is a bottom view of the two skewed (angled) diamond sections A and B showing the joining of the two cutting planes AC—AC and BC—BC of sections A and B, respectively, to form the heart-shaped diamond.

As shown in FIGS. 4, 7 and 9 the diamond 20 includes a base surface 60 having a center culet or a first main culet 62 located on the point defined by the intersection 64 of the central vertical planes passing through both the longitudinal axis line 22 and the cross-axis line 28. Base surface 60 further includes pavilion facets confined with the bottom section of pear-shaped diamond 20, as depicted in FIGS. 4 to 6 of the drawings. The pavilion facets are defined by a pavilion top-end facet 66 and a pair of opposed pavilion side facets 68 and 70, respectively. Pavilion top-end facet 66 includes a plurality of angled top pavilion facets 72, and pavilion side facets 68 and 70 each include a plurality of angled side pavilion facets 74 and 76, respectively, as shown in FIG. 4 of the drawings.

Figure 2:
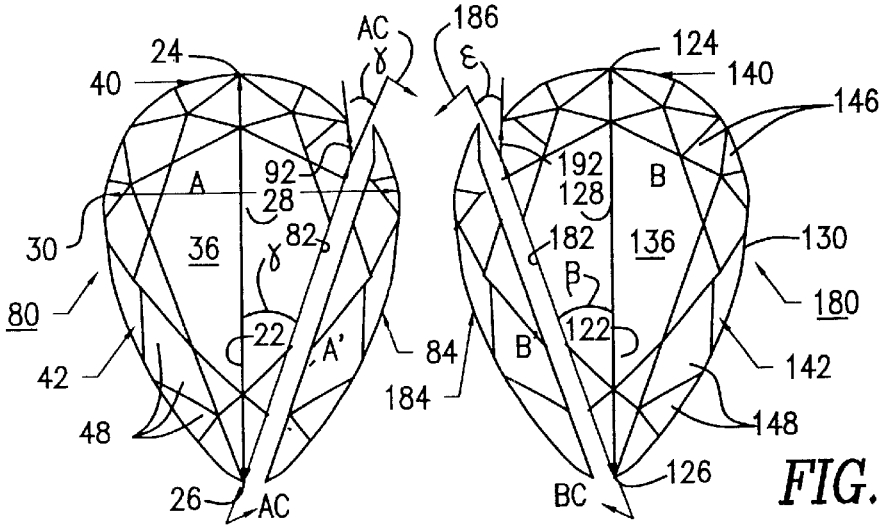
FIG. 2 is a top view of the two pear-shaped diamonds after being cut along each of the cutting planes AC—AC, GC—GC, BC—BC and EC—EC, respectively, to form skewed sections A, A', B and B' from the pear-shaped diamonds PSA and PSB, respectively.
Figure 12:
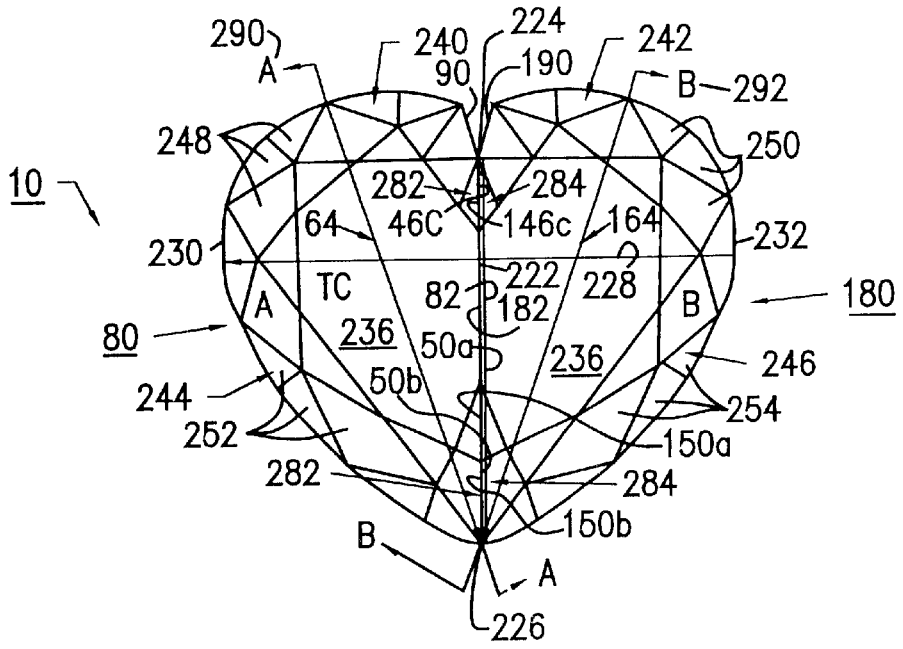
FIG. 12 is a top view of the heart-shaped diamond of the present invention showing the mating engagement of each of the diamond sections A and B cut from the pear-shaped diamonds PSA and PSB and joined together along the cutting planes AC—AC and BC—BC to form the heart-shaped diamond.
Figure 13:
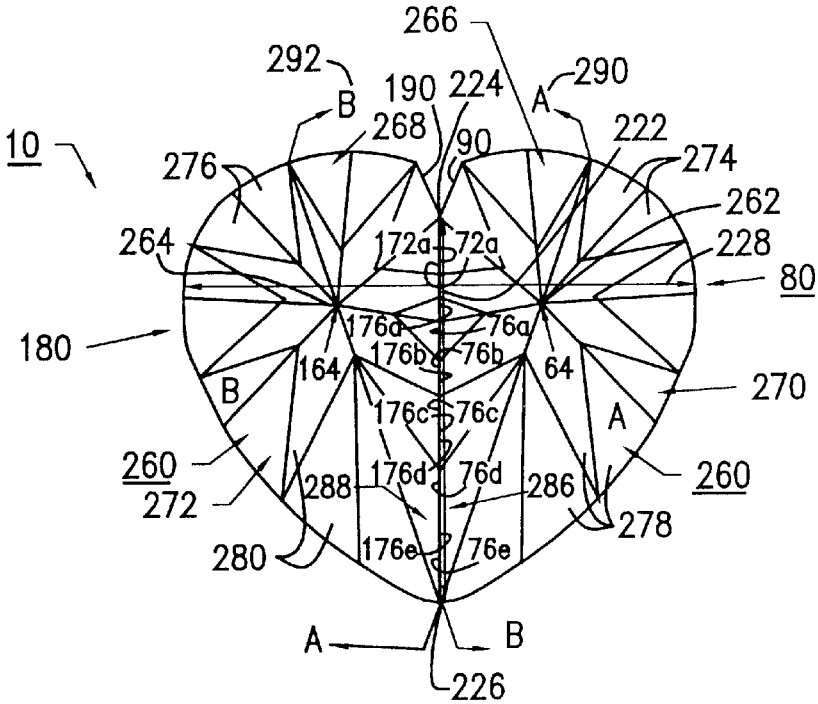
FIG. 13 is a bottom view of the heart-shaped diamond of the present invention showing the mating engagement of each of the diamond sections A and B cut from the pear-shaped diamonds PSA and PSB and joined together along the cutting planes AC—AC and BC—BC to form the heart-shaped diamond.

To form the first skewed (angled) diamond section 80, a first cutting longitudinal axis line 82 is established on the table 36 of diamond 20, forming a cutting angle alpha $\alpha$ relative to central axis 22. Angle a is in the range of 10° to 30° degrees with a preferred cutting angle $\alpha$ of 18° degrees. Axis line 82 defines a cutting plane AC—AC 86, as shown in FIGS. 1 to 6 of the drawings. A diamond cutter cuts the first pear-shaped diamond 20 along cutting line 82 to remove section (A') 84 and thereby forms the first skewed (angled) diamond section (A) 80, as depicted in FIGS. 1 and 2 of the drawings. The heart-shaped diamond 10 is formed by the joining together of the first and second skewed (angled) diamond sections (A and B) 80 and 180, as depicted in FIGS. 12, 13 and 14 of the drawings, such that the axis lines 82 and 182 mate, and the cutting planes AC—AC 86 and BC—BC 186 are in contact with each other to form the appearance of a heart-shape diamond.

Figure 3:
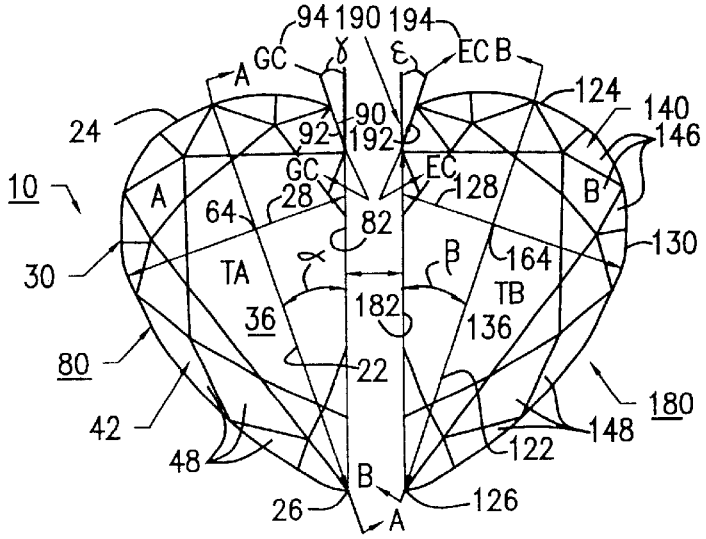
FIG. 3 is a top view of the two skewed (angled) diamond sections A and B showing the joining of the two cutting planes AC—AC and BC—BC of sections A and B, respectively, to form the heart-shaped diamond.
Figure 14:
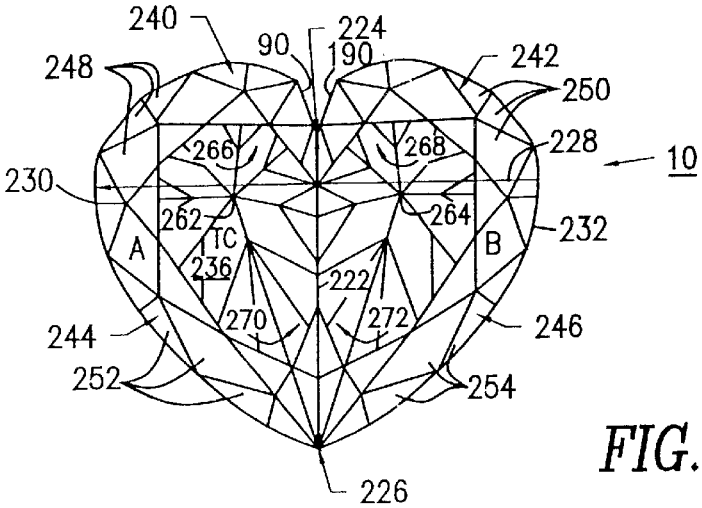
FIG. 14 is a top view of the two skewed (angled) diamond sections A and B depicting the top facets and the bottom facets within the newly formed table TC, and showing the mating engagement of the two cutting planes AC—AC and BC—BC of sections A and B to form the heart-shaped diamond.
Figure 15:
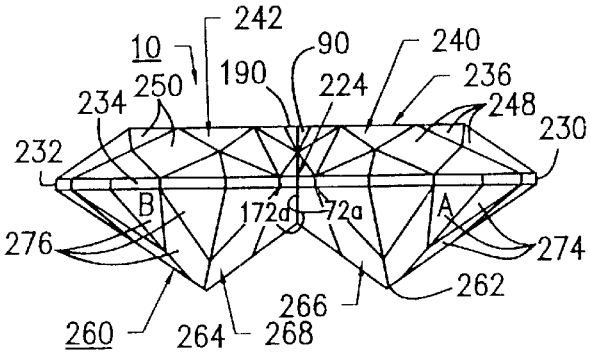
FIG. 15 is a top end elevational view of the heart-shaped diamond of the present invention showing the mating engagement of each of the diamond sections A and B cut from the pear-shaped diamonds PSA and PSB and joined together along the cutting planes AC—AC and BC—BC to form the heart-shaped diamond having a V-shaped notch.
Figure 16:
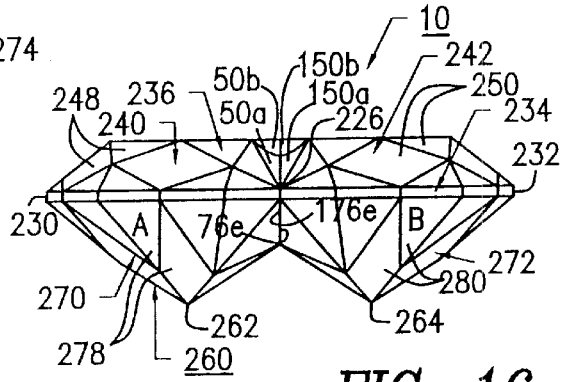
FIG. 16 is a bottom point-end elevational view of the heart-shaped diamond of the present invention showing the mating engagement of each of the diamond sections A and B cut from the pear-shaped diamonds PSA and PSB and joined together along the cutting planes AC—AC and BC—BC to form the heart-shaped diamond having a pointed end tip.

To form the first inner notch side 90 of the V-shaped notch 224 of heart-shaped diamond 10, as shown in FIGS. 1 to 6, and 11 to 14, a third cutting longitudinal axis line 92 defining a cutting plane GC—GC 94 therethrough is established on the table 36 of diamond 20, having a cutting angle gamma $\gamma$ in the range of 10° to 40° degrees with a preferred cutting angle $\gamma$ of 24° degrees. The cutting angle $\gamma$ is measured between the first cutting longitudinal axis line 82 and the third cutting longitudinal axis line 92, as depicted in FIGS. 3 and 6 of the drawings. A diamond cutter cuts and/or abrades part of the top-end angled facet 46*b* by cutting or abrading up to the third cutting plane GC—GC 94 of the first skewed (angled) diamond section (A) 80. This forms the first inner notch side 90 of the V-shaped notch 224 of the formed heart-shaped diamond 10, as depicted in FIG. 14 of the drawings.

The second pear-shaped diamond (PSB) 120, as shown in FIGS. 1 to 4 of the drawings, includes a longitudinal central axis line 122 extending from end edge 124 to opposed end point 126, and a short cross-axis line 128 extending from side edge 130 to opposed side edge 132. The axis lines 122 and 128 are determined by the parameters of the girdle 134 of diamond 120. The longitudinal axis line 122 is longer in dimension than the cross-axis line 128. The table 136 of diamond 120 refers to that flat, horizontal planar surface confined within the crown facets. The crown facets are defined by a crown top-end facet 140 and a pair of opposed crown side facets 142 and 144, respectively. Crown top-end facet 140 includes a plurality of angled top crown facets 146. Crown side facets 142 and 144 each include a plurality of angled side crown facets 148 and 150, respectively, as shown in FIG. 1 of the drawings.

As shown in FIGS. 4, 7 and 9, the diamond 120 includes a base surface 160 having a center culet or a main culet 162 being located on the point defined by the intersection 164 of the central vertical planes passing through both the longitudinal axis line 122 and the cross-axis line 128. Base surface 160 further includes pavilion facets confined with the bottom section of pear-shaped diamond 120, as depicted in FIGS. 4, 5 and 6 of the drawings. The pavilion facets are defined by a pavilion top-end face 166 and a pair of opposed pavilion side facets 168 and 170, respectively. Pavilion top-end facet 166 includes a plurality of angled top pavilion facets 172, and pavilion side facets 168 and 170 each include a plurality of angled side pavilion facets 174 and 176, respectively, as shown in FIG. 4 of the drawings.

To form the second skewed (angled) diamond section 180, a cutting longitudinal axis line 182 is established on the table 136 of diamond 120 forming a cutting angle beta $\beta$ relative to central axis 122. Angle beta $\beta$ is in the range of 10° to 30° degrees with a preferred cutting angle $\beta$ of 18 degrees. Axis line 182 defines a cutting plane BC—BC 186, as shown in FIGS. 1 to 6 of the drawings. A diamond cutter cuts the second pear-shaped diamond 120 by removing section (B') 184 and thereby forms the second skewed (angled) diamond section (B) 180, as depicted in FIGS. 1 and 2 of the drawings. The heart-shaped diamond 10 is formed by the joining together of the first and second skewed (angled) diamond sections (A and B) 80 and 180, as depicted in FIGS. 6, 7 an 8 of the drawings, such that the axis lines 82 and 182 mate, and the cutting planes AC—AC 86 and BC—BC 186 are in contact with each other to form the appearance of a heart-shaped diamond.

To form the second inner notch side 190 of the V-shaped notch 224 of heart-shaped diamond 10, as shown in FIGS. 1 to 6, and 11 to 14, a fourth cutting longitudinal axis line 192 defining a cutting plane EC—EC 194 therethrough is established on the table 136 of diamond 120, having a cutting angle epsilon $\epsilon$ in the range of 10° to 40° degrees with a preferred cutting angle $\epsilon$ of 24° degrees. The cutting angle $\epsilon$ is measured between the second cutting longitudinal axis line 182 and the fourth cutting longitudinal axis line 192, as depicted in FIGS. 3 and 6 of the drawings. A diamond cutter cuts and/or abrades part of the top-end angled facet 146*b* by cutting or abrading up to the third cutting plane EC—EC 194 of the second skewed (angled) diamond section (B) 180. This forms the second inner notch side 190 of the V-shaped notch 224 of the formed heart-shaped diamond 10, as depicted in FIG. 14 of the drawings.

The now formed heart-shaped diamond 10, as shown in FIGS. 12, 13 and 14 of the drawings, includes a central longitudinal axis line 222 extending from the V-shaped notch 224 at the top to opposed end point 226, and a central cross-axis 228 extending from side edge 230 to opposed side edge 232. The axis lines 222 and 228 are determined by the parameters of girdle 234. The central longitudinal axis 222 is slightly shorter in dimension then the central cross-axis line 228. The table 236 of the heart-shaped diamond 10 is the flat, horizontal planar surface confined by the crown facets. The crown facets are defined by a pair of adjacent crown top-end facets 240 and 242, and a pair of opposed crown side facets 244 and 246, respectively. Crown top-end facets 240 and 242 each include a plurality of angled facets 248 and 250, respectively. Crown side facets 244 and 246 each include a plurality of angled facets 252 and 254, respectively, as shown in FIG. 6 of the drawings.

As shown in FIGS. 13 and 14, the heart-shaped diamond includes a base surface 260 having a pair of main or center culets 262 and 264 (a first main culet 262 and a second main culet 264) being located on the points defined by the intersections 64 and 164 of each of the central vertical planes A—A 290 and B—B 292 passing through both the longitudinal axis line 22 and the cross-axis line 28 and the longitudinal axis line 122 and the cross-axis line 128, respectively. Base surface 260 further includes pavilion facets confined by the bottom section of heart-shaped diamond 10. The pavilion facets are defined by a pair of pavilion top-end facets 266 and 268 and a pair of opposed pavilion side facets 270 and 272, respectively. Pavilion top-end facets 266 and 268 each include a plurality of angled top pavilion facets 274 and 276, respectively, and pavilion side facets 270 and 272 each include a plurality of angled side pavilion facets 278 and 280, respectively, as shown in FIGS. 12 and 13 of the drawings.

Figure 17:
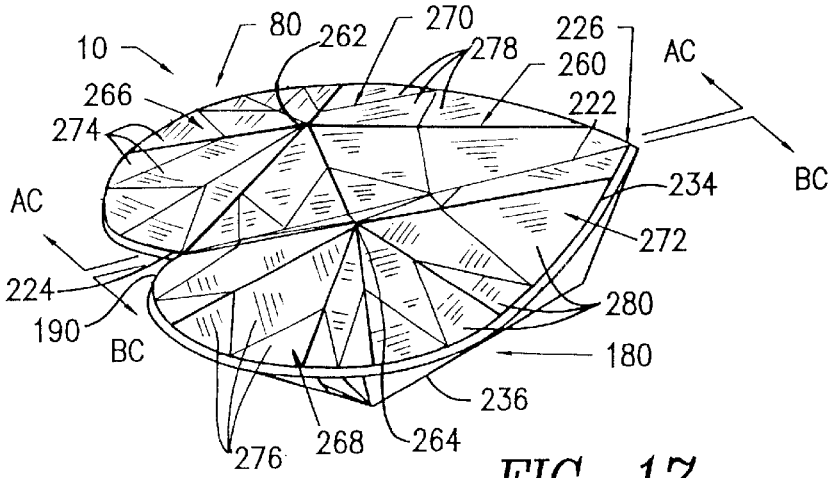
FIG. 17 is a bottom perspective view of the heart-shaped diamond of the present invention showing each of the diamond sections A and B cut from the pear-shaped diamonds PSA and PSB and joined together along the cutting planes AC—AC and BC—BC to form the heart-shaped diamond.

As shown in FIGS. 12 and 14, when diamond sections (A and B) 80 and 180 are aligned and mated to form new table 236, angled top crown facets 46*c* and 146*c*, and angled side crown facets 50*a*, 150*a*, 50*b*, and 150*b* are matingly engaged and aligned with each other to form an interior crown section area of inner crown facets 282 and 284, respectively. Correspondingly, when diamond sections (A and B) 80 and 180 are aligned and mated to form the new base surface 260, angled top pavilion facet 72*a* is mated with facet 172*a*. In addition, angled side pavilion facets 76*a*, 76*b*, 76*c*, 76*d*, and 76*e* are matingly engaged and aligned with facets 176*a*, 176*b*, 176*c*, 176*d*, and 176*e* to form an interior pavilion section of inner pavilion facets 286 and 288, respectively, as depicted in FIGS. 13 and 17 of the drawings.

Figure 18:
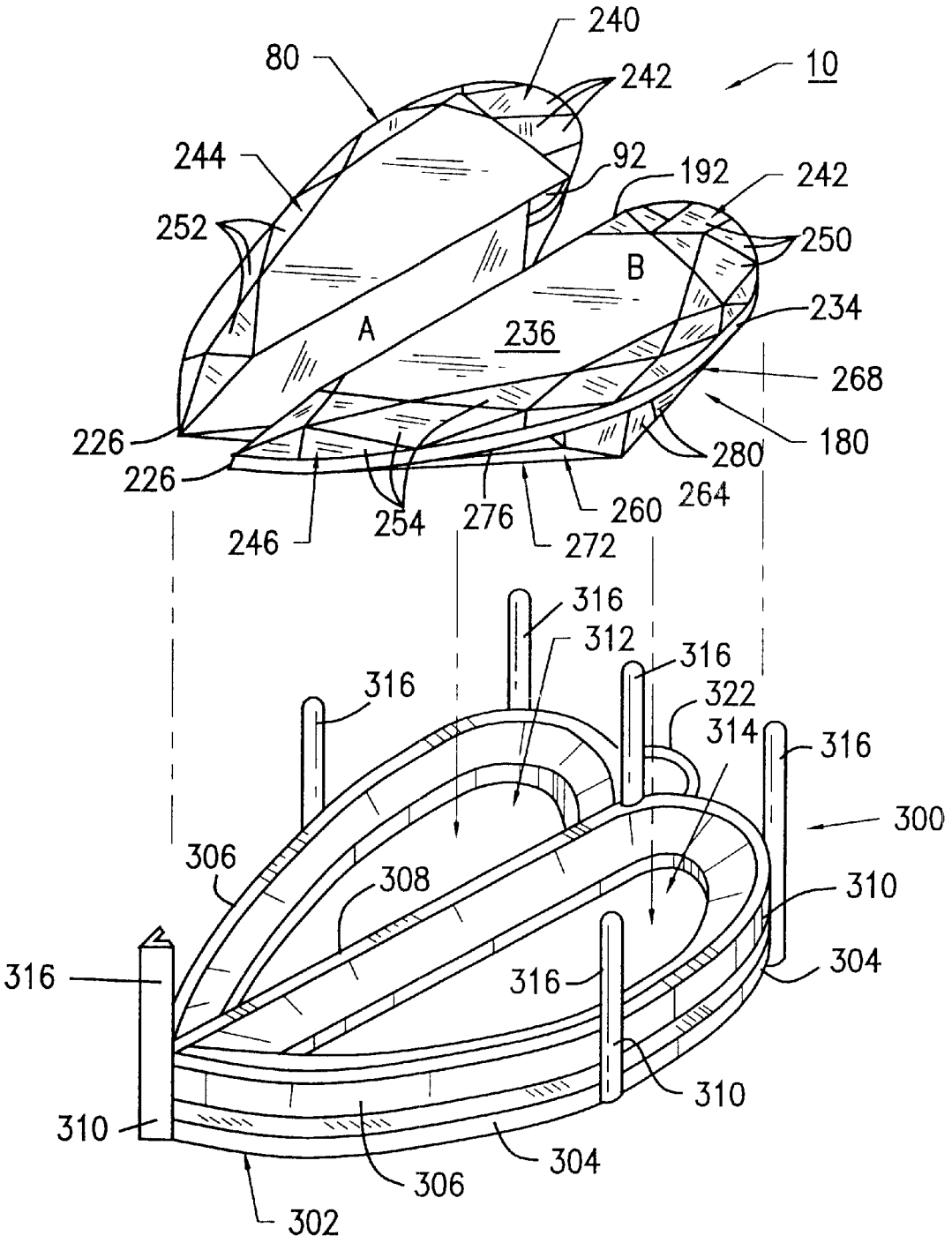
FIG. 18 is an exploded perspective view of the heart-shaped diamond of the present invention showing the joined skewed (angled) diamond sections A and B being placed within a heart-shaped metal setting for holding in place the formed heart-shaped diamond.
Figure 19:
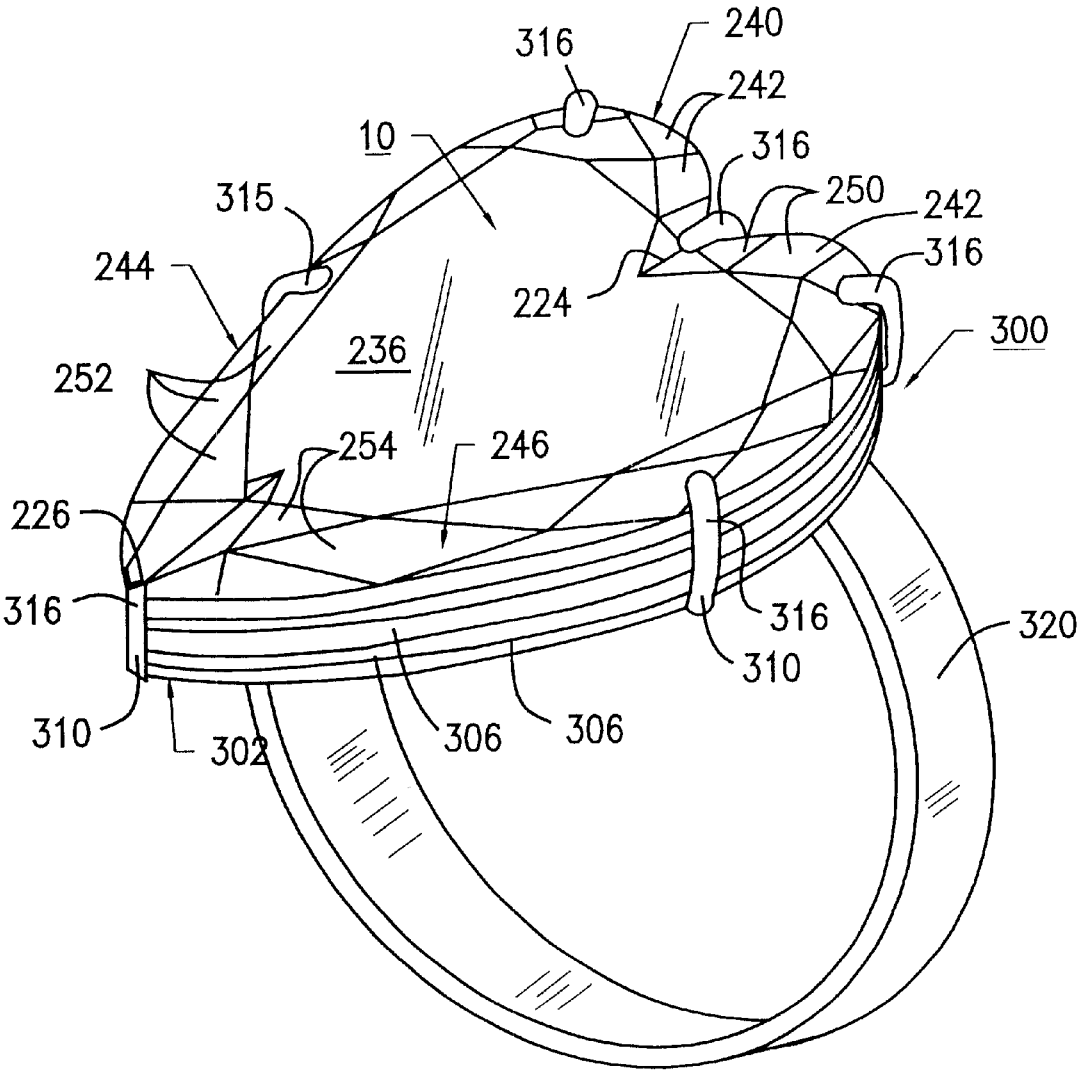
FIG. 19 is a perspective view of the heart-shaped diamond of the present invention showing the joined skewed (angled) diamond sections A and B being held in place within the heart-shaped metal setting for holding the formed, heart-shaped diamond therein.

The heart-shaped gem setting 300, as shown in FIGS. 18 and 19 of the drawings, includes a frame member 302 in the shape of a heart having a lower tier frame section 304 and an upper tier frame section 306 with a center bar 308 therebetween. A plurality of vertical connecting prongs 310 are provided for connecting the upper tier frame section 304 to the lower tier frame section 306. In addition, setting 300 includes engaging prongs 316 extending upwardly from upper tier frame 306 for engaging and holding in place each of the skewed diamond sections 80 and 180. Upper tier frame section 306 includes a first seating area 312 and a second seating area 314 having the center bar 308 therebetween, as depicted in FIG. 9 of the drawings. Optionally, the heart-shaped gem setting 300 may also include a ring member 320 or a pendant holding member 322 for use with different types of ornamental jewelry such as rings or pendants and the like, as depicted in FIGS. 18 and 19 of the drawings. Gem setting 300 can be made of gold, silver, platinum, palladium or other precious metals.

OPERATION OF THE INVENTION

The jeweler must set the two skewed (angled) diamond sections (A and B) 80 and 180 that were formed by the diamond cutter cutting the two pear-shaped diamonds (PSA and PSB) 20 and 120 (as previously described). First, the jeweler inserts and seats the first skewed diamond section (A) 80 within the first seating area 312 of the upper tier frame section 306 of gem setting 300. Next, the jeweler inserts and seats the second skewed diamond section (B) 180 within the second seating area 314 of the upper tier frame section 306 of gem setting 300. The jeweler aligns, mates and engages the two cutting planes (AC—AC) 86 and (BC—BC) 186 of first and second diamond sections (A and B) 80 and 180. Once so aligned, the two tables 36 and 136 of diamond sections (A and B) 80 and 180 form a new single table 236 and form the appearance of a single diamond 10 in the shape of a heart, as depicted in FIGS. 6, 9 and 10 of the drawings.

Various types of heart-shaped gem settings 300 can be used to form rings, pendants, pins, brooches, clasps, necklaces, bracelets, anklets, and earrings in order to set heart-shaped gems such as diamonds, rubies, emeralds, sapphires and the like made by this aforementioned process. The size of the heart-shaped diamond 10 and gem setting 300 may vary, and the heart-shape configuration may also be changed according to the overall shape of the pear-shaped diamonds 20 and 120 used in the forming of the skewed diamond sections 80 and 180, respectively. Larger size heart-shaped diamonds 10 could be used for brooches, pendants, pins, clasps and the like, while smaller heart-shaped diamonds 10 could be used for rings, earrings and the like.

ADVANTAGES OF THE PRESENT INVENTION

Accordingly, an advantage of the present invention is that it provides for a method of forming the appearance of a single heart-shaped gem by cutting two pear-shaped gems, and placing the two cut gem sections side-by-side in a heart-shaped metal setting for holding them in place to form the appearance of a single heart-shaped gem for making a particular type of ornamental jewelry to be worn by the user.

Another advantage of the present invention is that it provides for a method of forming a heart-shaped gem by cutting two pear-shaped gems such as diamonds, rubies, emeralds, sapphires, and the like.

Another advantage of the present invention is that it provides for a method of forming a heart-shaped gem for use in personal adornment in the form of ornamental jewelry such as rings, pins, brooches, pendants, clasps, necklaces, bracelets, anklets and earrings.

A further advantage of the present invention is that it provides for a method of forming a heart-shaped gem that is easy to mount within a metal setting and wherein the formed heart-shaped gem will not separate once mounted.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of making a heart shape diamond for setting same in a heart-shaped setting having a first seating area and a second seating area separated by a cross bar, comprising the steps of:

a) cutting a first pear-shaped diamond along a first cutting plane to form a first heart-shaped diamond section having a first mating surface and a first table;

b) cutting a second pear-shaped diamond along a second cutting plane to form a second heart-shaped diamond section having a second mating surface and a second table; and c) seating said first heart-shaped diamond section in said first seating area and seating said second heart-shaped diamond section in said second seating area with said first mating surface engaging said second mating surface to form a heart shape diamond with said first table and said second table forming the appearance of a single table of said heart shape diamond.

2. A method for making heart shape diamond in accordance with claim 1, wherein said first pear-shaped diamond has a first culet and said second pear-shaped diamond has a second culet, and wherein the step of seating includes seating said first culet in said first seating area, and seating said second culet in said second seating area.

3. A method of making a heart shape diamond in accordance with claim 1, wherein said first pear-shaped diamond has a first central axis, and wherein said cutting step includes cutting said first pear-shaped diamond along a first cutting plane which forms an angle alpha $\alpha$ with said first central axis, and wherein said angle alpha $\alpha$ is in the range of 10° to 30°.

4. A method of making heart shape diamond in accordance with claim 3, wherein said angle alpha $\alpha$ is 18°.

5. A method of making a heart shape diamond in accordance with claim 1, wherein said second pear-shaped diamond has a second central axis, and wherein said cutting step includes cutting said second pear-shaped diamond along a second cutting plane which forms an angle beta $\alpha$ with said second central axis, and wherein said angle bata $\beta$ is in the range of 10° to 30°.

6. A method of making a heart shape diamond in accordance with claim 5, wherein said angle beta $\beta$ is 18°.

7. A method of making a heart shape diamond in accordance with claim 1, wherein said first pear-shaped diamond has first facets, and wherein said second pear-shaped diamond has second facets, and wherein said step of cutting includes cutting said first and second diamond sections so that said first and second facets are aligned to enhance the brilliance of said heart-shaped diamond.

8. A method of making a heart shape diamond in accordance with claim 1, further including the step of cutting a first and second inner notch side for forming a V-shaped notch in said heart-shaped diamond.

9. A method of making a heart shape diamond in accordance with claim 1, wherein said first pear-shaped diamond further includes a third cutting plane, and wherein said cutting step includes cutting said first pear-shaped diamond along said third cutting plane which forms an angle gamma $\gamma$ with said first cutting plane, and wherein said angle gamma $\gamma$ is in the range of 10° to 40° for forming a first inner notch side along said third cutting plane of said heart-shaped diamond.

10. A method of making a heart shape diamond in accordance with claim 9, wherein said angle gamma $\gamma$ is 24°.

11. A method of making a heart shape diamond in accordance with claim 1, wherein said second pear-shaped diamond further includes a fourth cutting plane, and wherein said cutting step includes cutting said second pear-shaped diamond along said fourth cutting plane which forms an angle epsilon $\epsilon$ with said second cutting plane, and wherein said angle epsilon $\epsilon$ is in the range of 10° to 40° for forming a second inner notch side along said fourth cutting plane of said heart-shaped diamond.

12. A method of making a heart shape diamond in accordance with claim 1, wherein said angle epsilon $\epsilon$ is 24°.

* * * * *